US007451504B2

(12) United States Patent
Arft

(10) Patent No.: US 7,451,504 B2
(45) Date of Patent: Nov. 18, 2008

(54) SOFA SLEEPER WITH LOW-PROFILE HEAD RAIL

(75) Inventor: Dennis Arft, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 92 days.

(21) Appl. No.: 11/553,818

(22) Filed: Oct. 27, 2006

(65) Prior Publication Data

US 2008/0098518 A1 May 1, 2008

(51) Int. Cl.
*A47C 17/04* (2006.01)

(52) U.S. Cl. ..... 5/13; 5/12.1; 5/28

(58) Field of Classification Search ..... 5/13, 5/28–29, 36, 12.1
See application file for complete search history.

(56) References Cited

U.S. PATENT DOCUMENTS 3,984,883 A 10/1976 Wong
4,035,852 A 7/1977 Cycowicz et al.
4,592,102 A 6/1986 Mizelle
4,669,134 A 6/1987 Mikos
4,918,770 A 4/1990 Hartline et al.
5,075,909 A 12/1991 Arft
5,138,727 A 8/1992 Hanes et al.
5,450,637 A * 9/1995 Hanes et al. ..... 5/13
5,903,939 A 5/1999 Arft
6,035,464 A 3/2000 Williams

* cited by examiner

*Primary Examiner*—Fredrick Conley
(74) *Attorney, Agent, or Firm*—Shook, Hardy & Bacon, L.L.P.

(57) ABSTRACT

This invention is directed to a sofa sleeper mechanism having a head section, a main middle section, a secondary middle section and a foot section. The head section has a head end and an end opposing the head end. The foot section has a foot end and an end opposing the foot end. The opposing end of the head section is pivotally connected to the main middle section, which is pivotally connected to the secondary middle section, which is pivotally connected to the opposing end of the foot section. The sofa sleeper mechanism is movable from a stowed position to an extended position, wherein, in the stowed position, the uppermost edge of the head end does not extend substantially above the folded foot section.

17 Claims, 7 Drawing Sheets

SOFA SLEEPER WITH LOW-PROFILE HEAD RAIL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates generally to a sofa sleeper and, more particularly, to a folding sofa sleeper mechanism having a low-profile head rail, whereby the mechanism can be disposed in a forward-biased orientation within a sofa frame and the mechanism will neither extend into the sofa frame back cavity nor conflict with the breast rail of the sofa frame.

As illustrated in FIG. 1, traditional sofa sleepers contain a folding mechanism 100 with a head section 102 that, when stowed, extends beyond the breast rail 104 and into the back cavity 106. Modern sofa sleeper designs, however, have a deeper seating area that, while in the sofa position, extend the seat cushion area and increase the distance between the back cushions and the front of the sofa sleeper. Due to the extension of the seat cushion area, the deep-seated sofa sleepers necessarily have a sofa frame that is longer from back to front than traditional sofa sleeper frames. As can be appreciated by referencing the illustration in FIG. 9, leaving the traditional folding sofa sleeper mechanism 100 in a rear-biased orientation near the back rail 108 causes the mechanism to conflict with the front rail 110 when the mechanism is unfolded from a stowed, sofa position into an extended, sleeper position. Additionally, as can be appreciated by again referencing FIG. 9, moving the traditional sofa sleeper mechanism 100 forward will cause the head section 102 to interfere with the breast rail 104, adversely affecting the functionality of the sofa sleeper.

Thus, it would be desirable to manufacture a folding sofa sleeper mechanism with a low-profile head rail that can be configured with both traditional and modern sofa sleeper frames.

SUMMARY OF THE INVENTION

This invention is directed to a sofa sleeper. The sofa sleeper contains a sofa frame, a folding mechanism and a mattress. The folding mechanism is coupled to the sofa frame. The folding mechanism is movable between a stowed, sofa position and an extended, sleeper position. The sofa frame includes at least a back, a breast rail, a front rail, and a back rail. The back portion defines a back cavity. The folding mechanism includes a frame with a head, main middle, secondary middle and foot sections. The sofa frame houses the folding mechanism when the sofa sleeper is in the sofa position. The head section is pivotally coupled to the main middle section which is, in turn, pivotally coupled to the secondary middle section and the secondary middle section is pivotally coupled to the foot section. Each of the portions of the folding mechanism frame contain a support surface and the support surfaces are used to support a mattress.

The folding mechanism also contains a support linkage system and an actuating and controlling linkage system. The support linkage system supports the head, main middle, secondary middle, and foot sections through their movement between the stowed, sofa and extended, sleeper positions. The actuating and control linkage system transmits the folding and unfolding movement to the sections of the folding mechanism frame.

In the stowed, sofa position, the folding mechanism is configured to be compatible with both traditional and modern sofa sleeper frames. This is accomplished with a head rail that, in the stowed position, is disposed generally adjacent to the folded foot section. Thus, the low-profile head rail of the folding mechanism provides configurability with any style of sofa sleeper frame.

BRIEF DESCRIPTION OF THE SEVERAL VIEWS OF THE DRAWINGS

These and other objectives and advantages of the present invention will be more readily apparent from the following detailed description of the drawings of the preferred embodiment of the invention that are herein incorporated by reference and in which.

DETAILED DESCRIPTION OF THE INVENTION

Figure 1:
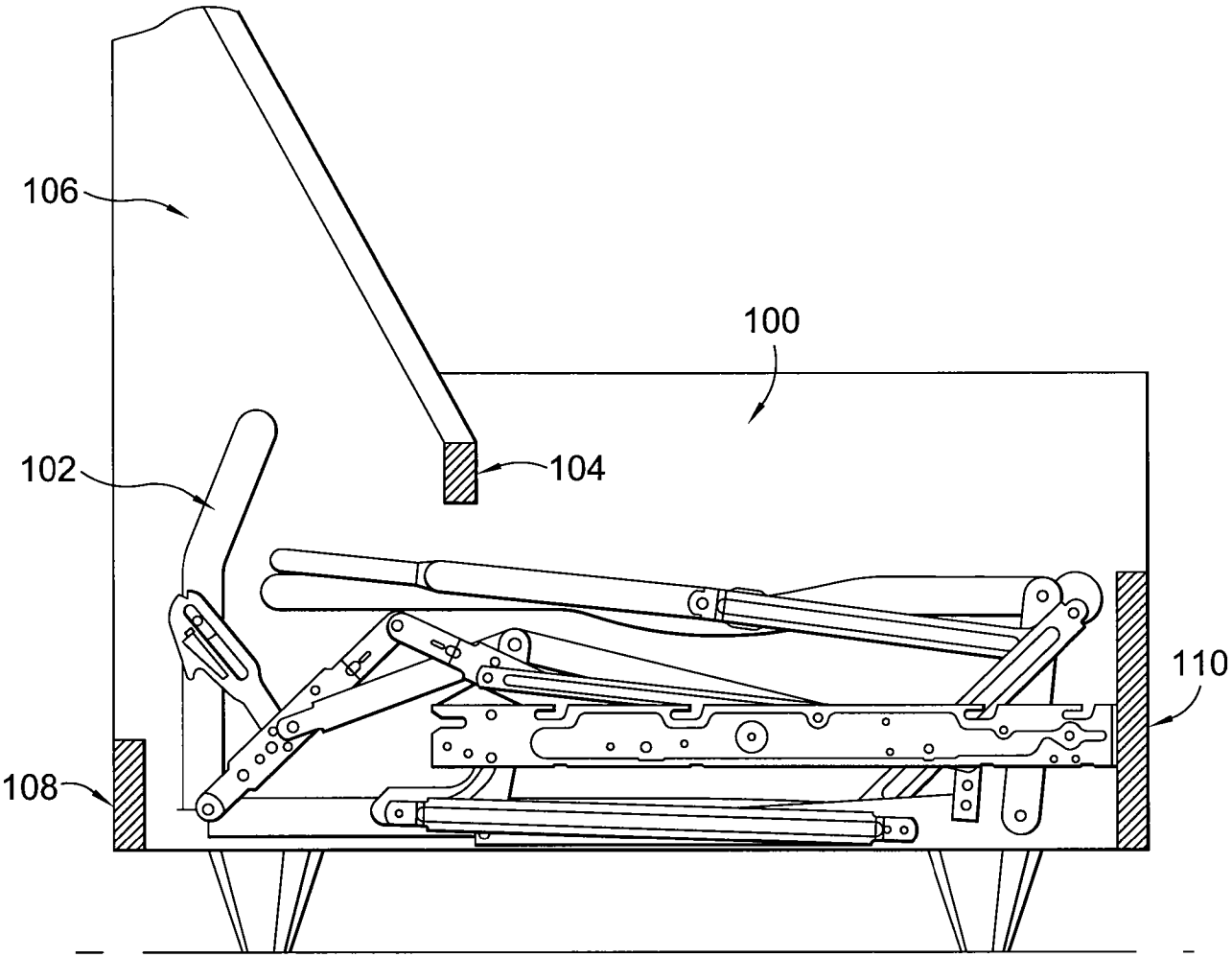
FIG. 1. PRIOR ART
FIG. 1 is profile view of the prior art sofa sleeper in a stowed, sofa position.
Figure 2:
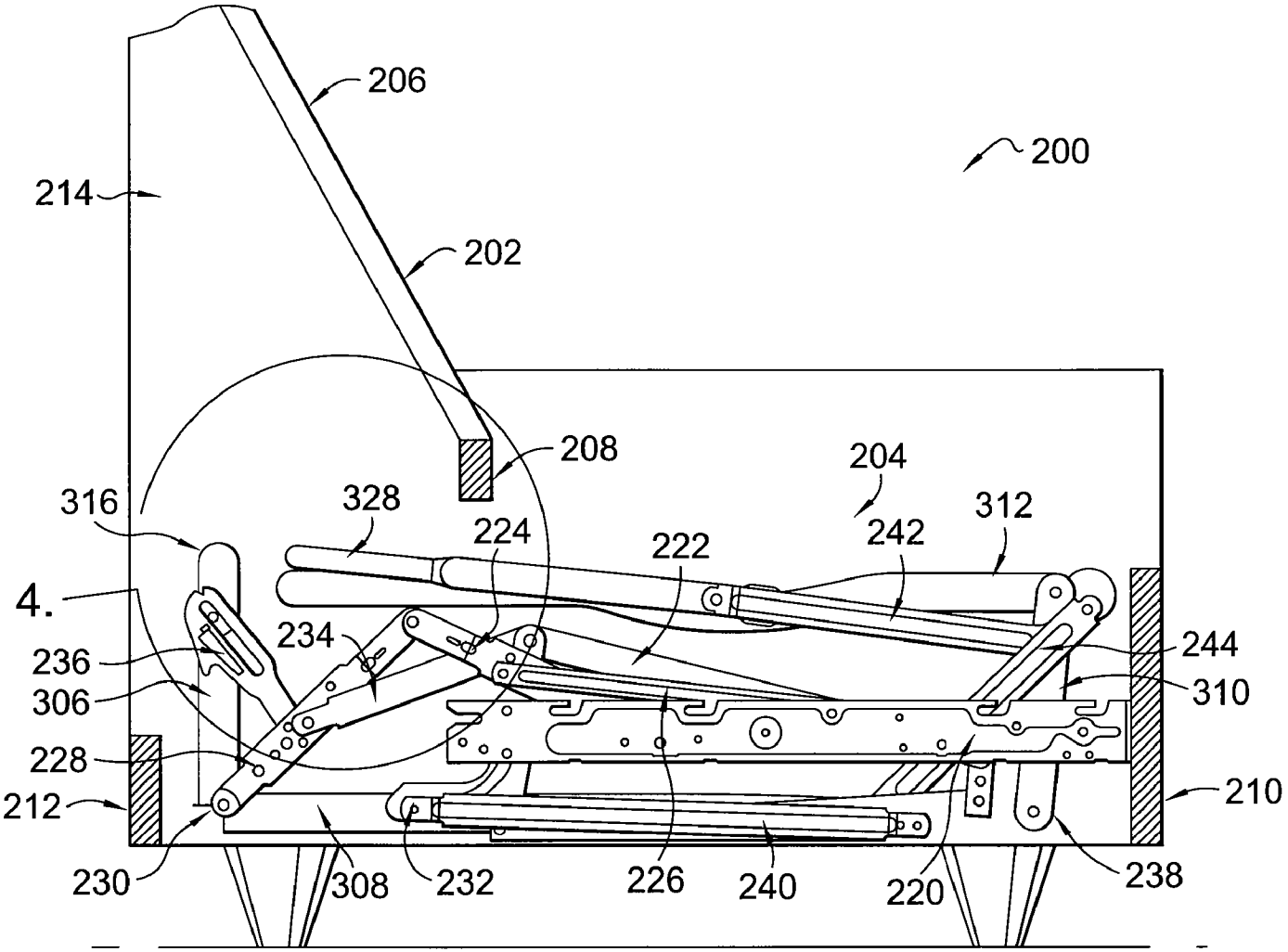
FIG. 2 is a profile view of a sofa sleeper, in the stowed, sofa position, according to the present invention.
Figure 3:
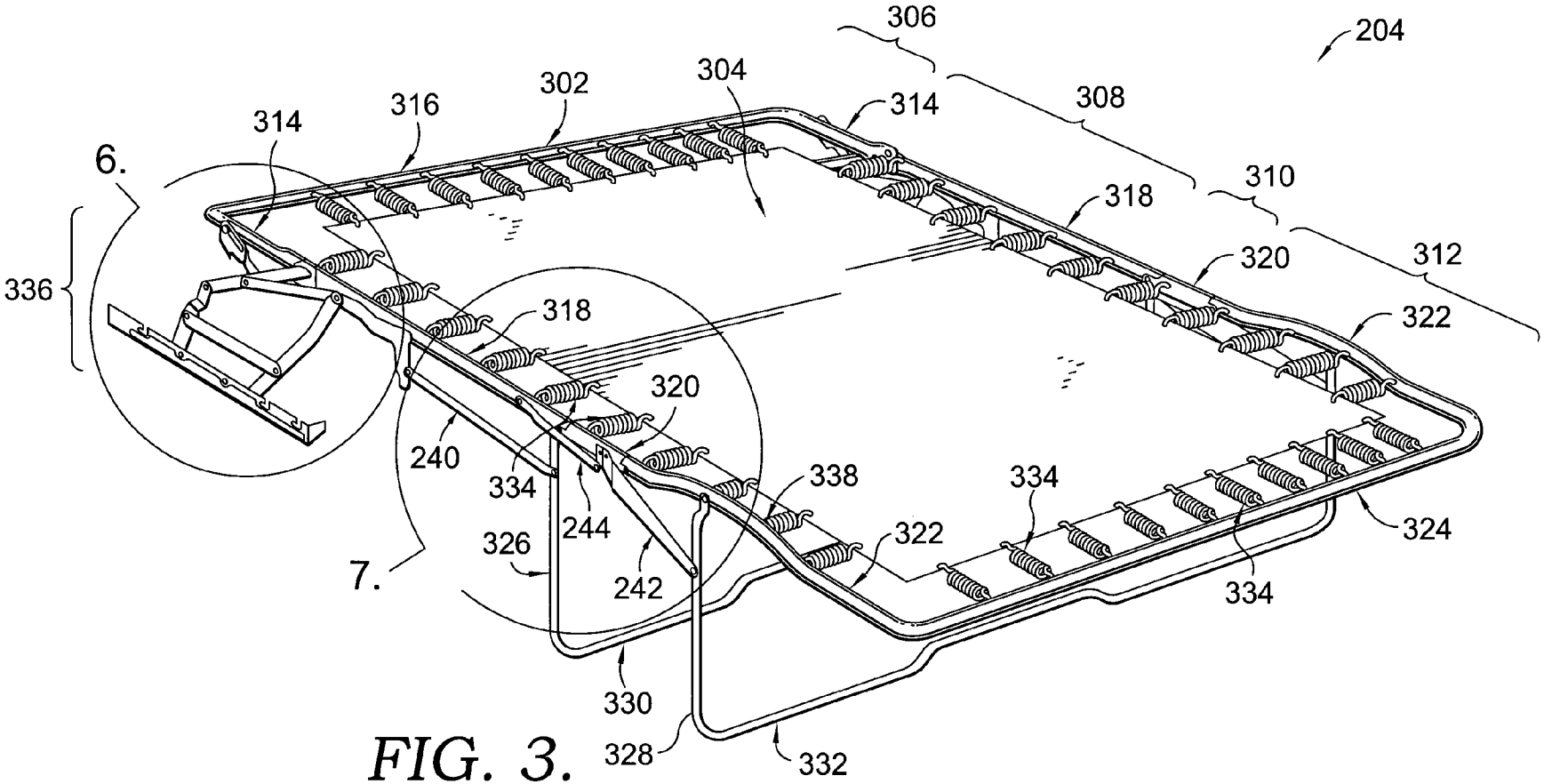
FIG. 3 is a perspective view of the folding mechanism in the extended, sleeper position according to the present invention.

With initial reference to FIGS. 2-3, a sofa sleeper according to the principles of the present invention is designated generally with the reference numeral 200. Throughout this specification, the term sofa sleeper 200 is also intended to encompass love seats and other furniture units as understood by one of ordinary skill in the art. The sofa sleeper can be converted from a stowed, sofa position, shown in FIG. 2, to an extended, sleeper position, shown in FIG. 3. As shown in FIG. 2, the sofa sleeper 200 includes a sofa frame 202 and a folding mechanism 204. The sofa frame includes at least a back 206, upholstered in the traditional manner, a breast rail 208, a front rail 210 and a back rail 212. Other elements of the frame 202 are not shown or discussed. Those of skill in the art are well aware of sofa frame configurations. As shown in FIG. 2, the back 206 defines a back cavity 214 extending up from the lowermost edge of the breast rail 208. As used herein, the terms "forward" and "rearward" and variations thereof define positions of the folding sofa sleeper mechanism 204 relative to the sofa frame 202, "forward" being the direction from the back rail 212 to the front rail 210 and "rearward" being the opposite direction.

Referring now to FIGS. 2-3, the folding mechanism 204 will be discussed. FIG. 2 illustrates the folding mechanism 204 in the stowed, sofa position, while FIG. 3 illustrates the folding mechanism 204 in the extended, sleeper position. The folding mechanism 204 is coupled with the sofa frame 202 and unfolds from a stowed position bounded by the front rail 210 and the back rail 212. The folding sofa sleeper mechanism 204 includes a frame 302 and a support surface 304. The folding mechanism frame 302 comprises a head section 306, a main middle section 308, a secondary middle section 310 and a foot section 312. At one end, the head section 306 is pivotally coupled to one end of the main middle section 308. The secondary middle section 310 is pivotally coupled at one end to the other end of the main middle section 308, and the secondary middle section 310 is pivotally coupled at the other end to one end of the foot section 312. The head section 306 includes similarly disposed left and right head side rails 314 which are connected with a head end rail 316. The main middle section 308, the secondary middle section 310 and the foot section 312 each comprise similarly disposed left and right side rails 318, 320, and 322 respectively. In the embodiment shown, side rails 322 of the foot section 312 are illustrated as having an arcuate portion 338 which curves upwardly when the assembly is in the extended, sleeper position with the frame sections extended. It will be appreciated by one of ordinary skill in the art that other side rail configurations can be used, such as non-curved side rails or the like. An end rail 324 connects the opposed side rails 322 of the foot section 312 and serves as the forwardmost edge of the frame 302 of the folding mechanism 204 when the mechanism is in the extended, sleeper position. The end rails 316, 324 and side rails 314, 318, 320, 322 of the head, main middle, secondary middle and foot sections respectively are illustrated as being circular in cross section. It will be appreciated by one of ordinary skill in the art that other side rail configurations can be used, such as rectangular, square, L-shaped or the like.

The pivotally connected frame sections 306, 308, 310, 312 are supported in their extended position by a pair of foldable middle support legs 326 pivotally connected at their upper ends to the back end of the side rails 320 of the secondary middle section 310, and a pair of foot section support legs 328 pivotally connected at their upper ends to the side rails 322 of the foot section 312. The middle support legs 326 are connected by a middle bottom bar 330 and the foot section support legs 328 are connected by a foot section bottom bar 332 respectively. Both the middle bottom bar 330 and the foot section bottom bar 332 rest on the floor when the frame sections are extended and the folding sofa sleeper mechanism is in the extended, sleeper position.

It will be understood by one of ordinary skill in the art that springs 334 and a support surface 304 extend across the frame 302. Specifically, the springs 334 couple the support surface 304 to the frame sections 306, 308, 310, 312 in a conventional manner to provide a support for a mattress (not shown). In an embodiment of the present invention, the mattress is secured to the head section 306 using wire mattress retainers or some other securing mechanism as understood by one of ordinary skill in the art. Additionally, the support surface 304, springs 334 and mattress arrangement provides, in a conventional manner, a horizontal surface for support thereon of the seat cushions of the sofa in the stowed position of the folding mechanism 204. Other than the mechanism for securing the mattress to the head section, neither the spring and support surface arrangement nor the mattress form any part of the present invention and, accordingly, are not described in detail herein.

Figure 6:
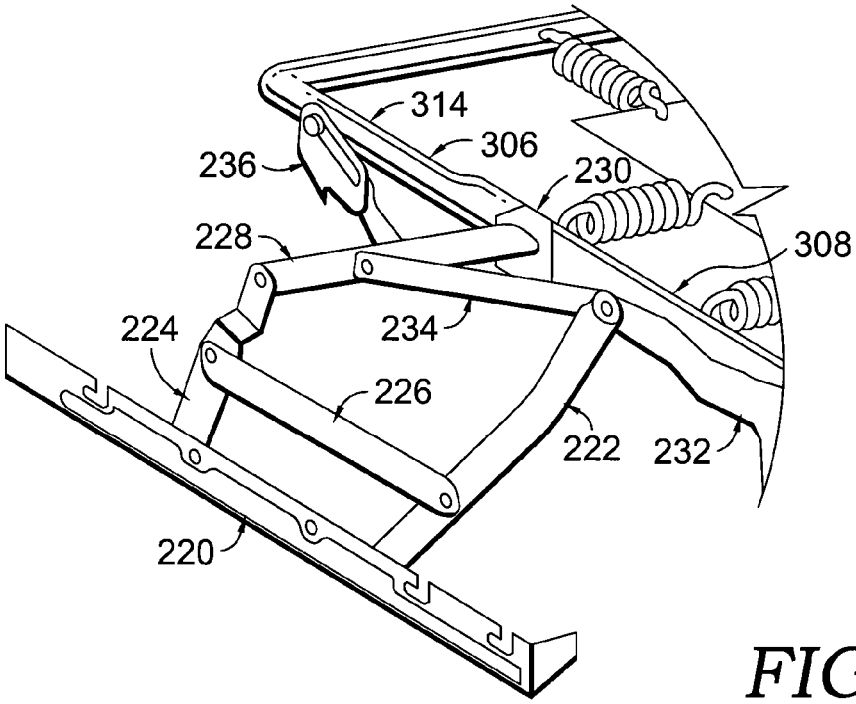
FIG. 6 is an enlarged portion of FIG. 3 showing the support linkage and the low-profile head rail in the extended, sleeper position.

In one embodiment of the present invention, as best illustrated in FIGS. 3 and 6, the head side rails 314 of head section 306 are shortened. Thus, in this embodiment, when the folding mechanism 204 is in the extended, sleeper position, the head section 306 is shorter from back to front than typical head sections as will be understood by one of skill in the art. As best illustrated in FIG. 3, in one embodiment of the present invention, the main middle section side rails 318 are elongated so that the folding mechanism 204 is capable of accommodating a standard size sofa sleeper mattress, even though the head section side rails 314 have been shortened. In another embodiment of the present invention, the foot section side rails 322 are elongated so that the folding mechanism 204 is capable of accommodating a standard size sofa sleeper mattress, even though the head side rails 314 have been shortened. Thus, in embodiments of the present invention, when the folding mechanism 204 is in the extended, sleeper position, the main middle section 308 and foot section 312 are longer from back to front than typical main middle and foot sections as will be understood by one of skill in the art.

In yet another embodiment of the present invention, as best illustrated in FIGS. 3 and 6, the head side rails 314 are generally linear. Thus, in this embodiment, when the folding mechanism 204 is in the extended, sleeper position, head section 306 is substantially flat and disposed in a generally horizontal orientation.

In order to support the folding sofa sleeper mechanism frame 302 for controlled collapsing movement into the sofa frame 202, there is a linkage system, generally designated by the numeral 336. The linkage system 336 extends between and interconnects the sofa frame 202 and the folding mechanism frame 302.

Referring still to FIGS. 2-3, the linkage system 336 will now be discussed. As the components of the folding mechanism 204 are identical on each side, only the components at one side thereof are illustrated and described herein. As will be understood by one of ordinary skill in the art, the linkage system 336 of the folding sofa sleeper mechanism 204 basically includes a support linkage system for supporting frame sections 306, 308, 310, 312 on the sofa frame 202 through their movement between their stowed, sofa and extended, sleeper positions. The linkage 336 also has an actuating and control linkage system associated with the support linkage for transmitting folding and unfolding movement to sections 306, 308, 310, 312. The support linkage system and the actuating and control linkage are cooperatively arranged to cause sections 306, 308, 310, 312 to fold relative to one another within the sofa frame 202. When folded, the head section 306 is disposed in a generally vertical orientation and the main middle section 308 and the foot section 312 are disposed forwardly of the head section 306 in a generally horizontal and substantially parallel orientation to one another. The main middle section 308 and the foot section 312 are spaced apart by the secondary middle section 310 which is disposed in a generally vertical orientation forwardly of the main middle and foot sections 308 and 312 respectively. Thus, the support linkage system and the actuating and control linkage system cause sections 306, 308, 310, 312 to unfold from the stowed, sofa position forwardly and upwardly from the sofa frame 202 over the front rail 210 to the extended, sleeper position. When the folding mechanism 204 is in the stowed, sofa position, the uppermost edge of the head end rail 316 is aligned generally adjacent to the generally horizontal plane created by the foot section 312 and the foot section support legs 328.

Referring now to FIGS. 2 and 6, the support linkage system will be discussed. As will be understood by one of ordinary skill in the art, the support linkage includes a horizontal support bracket 220 adapted for attachment to the sofa frame 202, two support links 222, 224, a control link 226, a secondary support link 228, and a bell-crank secondary support link 232. The support links 222, 224 are pivotally coupled at a horizontal spacing to the horizontal support bracket 220. A control link 226 extends between the support links 222, 224, the control link 226 being pivotally coupled at one end to an intermediate portion of the rear support link 224, and pivotally coupled at the other end to an intermediate portion of the front support link 222. The secondary support link 228 is pivotally coupled at one end with the rear support link 224 and extends and is pivotally coupled to the main middle section 308 at its pivot 230 with the head section 306, thereby providing support to sections 306, 308. The bell-crank secondary support link 232 is pivotally coupled at an intermediate point thereon to the side rail 318 intermediate its ends, as illustrated in FIG. 3, with one end of the secondary support link 232 pivotally coupled with the outward free end of the front support link 222, thereby providing additional support to the main middle section 308.

Figure 7:
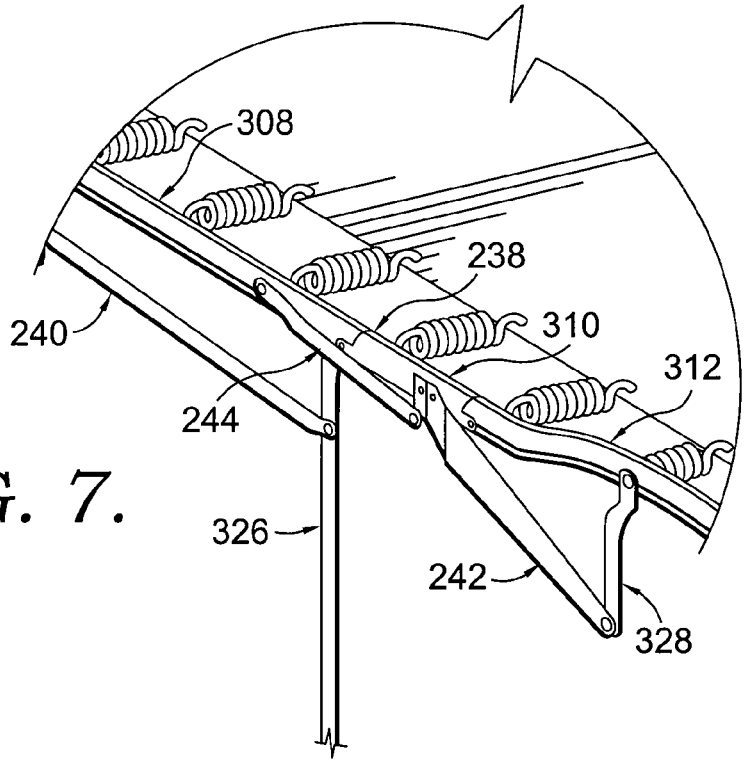
FIG. 7 is an enlarged portion of FIG. 3 showing the actuating and control linkage.

Referring now to FIGS. 2, 6 and 7, the actuating and control linkage system will be discussed. As will be understood by one of ordinary skill in the art, the actuating and control linkage extends substantially the length of the four sections 306, 308, 310, 312. Toward the head end 306, the linkage system includes a head section control link 234 and a head section actuating link 236. Link 234 is pivotally coupled at one end to an intermediate portion of the secondary support link 228. Link 234 extends to the outward free end of the front support link 222 and is commonly pivoted with link 222 and the secondary support link 232. Link 236 is pivotally coupled at one end to an intermediate portion of link 228 at a slight spacing from the pivot point between link 228 and link 234. Link 236 extends to a point and is pivotally coupled to a point intermediate the ends of rail 314 of the head section 306. The control link 234 and actuating link 236 are arranged to transmit folding and unfolding movement to the head section 306.

Toward the middle sections 308, 310 of the four sections 306, 308, 310, 312, the actuating and control linkage system includes an actuating link 240 as best seen in FIG. 7. Leg 326 is pivoted to the main middle section 308 at its forward end at the pivot 238 to provide additional support for the main middle section 308 in the extended position. As best seen in FIG. 3, link 240 is pivotally coupled at one end to the free arm of the secondary support link 232 and pivotally coupled at the opposite end to the middle support leg 326 at a slight spacing from the pivot 238. Link 240 is arranged to actuate pivoting of the middle support leg 236 between a folded disposition oriented alongside section 308 and a vertical disposition depending from section 308 upon moving sections 306, 308, 310, 312 between their stowed, sofa and extended, sleeper positions.

Toward the foot section 312, the actuating and control linkage system includes an actuating lever 242 and an angular actuating link 244. The foot section support leg 328 is pivotally coupled to an intermediate portion of the foot section 312 to provide support for the foot section 312 in the extended position. The actuating lever 242 is fulcrumed adjacent one end to an intermediate portion of the secondary middle section 310. Lever 242 is pivotally coupled at the opposite end to leg 328. One end of the angular actuating link 244 is pivotally coupled to the end of the actuating lever 242 adjacent its fulcrum, and the opposite end of link 244 is pivotally coupled to the main middle section 308 at a spacing from its pivot 238. Lever 242 and link 244 cooperatively actuate movement of the foot section support leg 328 between a folded disposition oriented along side the foot section 312 and a vertical disposition depending from the foot section 312 upon moving sections 306, 308, 310, 312 between their stowed and extended positions.

Figure 4:
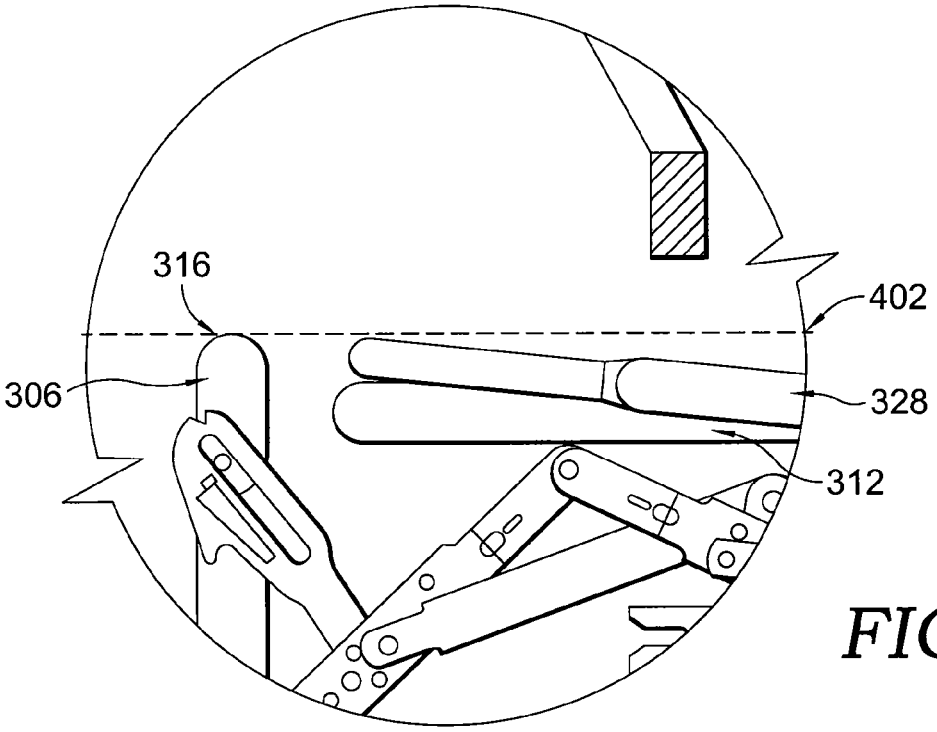
FIG. 4 is an enlarged portion of FIG. 2 showing the low-profile head rail in the stowed, sofa position.

Referring now to FIG. 4, the disposition of the folding mechanism 204 within the sofa frame 202, particularly the disposition of the head section 306 and foot section 312, is illustrated when the folding mechanism 204 is in the stowed, sofa position. In one embodiment of the present invention, the uppermost portion of the head section 306 at the uppermost edge of the head end rail 316 is generally adjacent to the generally horizontal plane 402 defined by the uppermost edge of the foot section 312 including the foot section support legs 328. In another embodiment of the present invention, the uppermost edge of the head end rail 316 is disposed at a spacing below the generally horizontal plane 402. The discussed embodiments of the present invention are accomplished because, as discussed above and as best illustrated in FIG. 3, head side rails 314 have been shortened. Additionally, as discussed above, when the folding mechanism 204 is in the extended, sleeper position, the length from back to front that is lost by shortening head section 306 is added to the side rails 318, 322 of the main middle and foot sections 308, 312.

Figure 5:
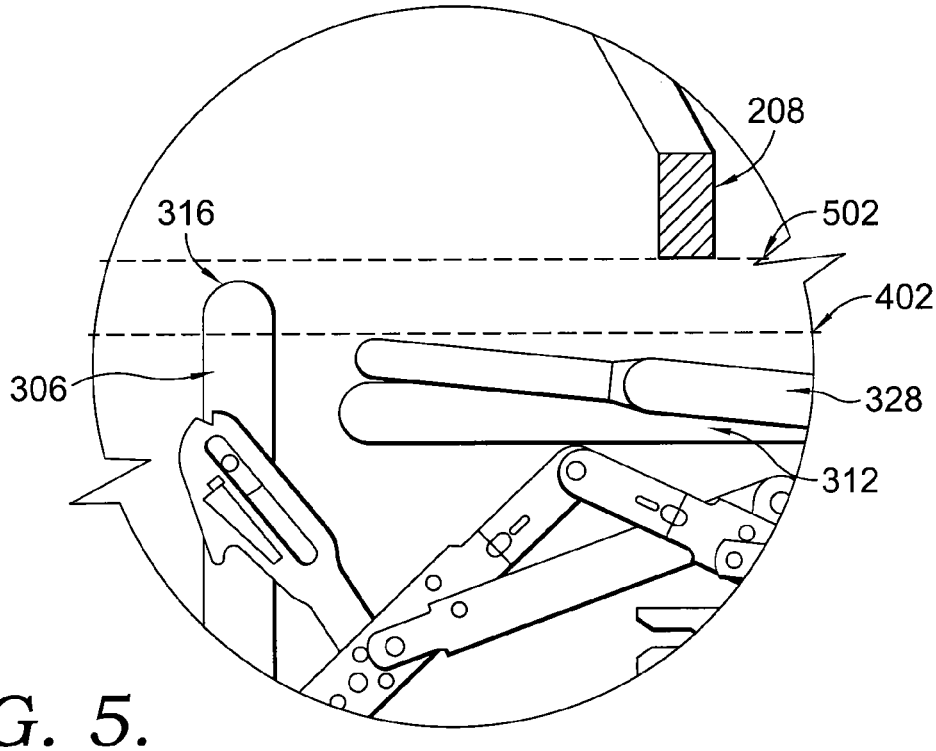
FIG. 5 is an enlarged portion, similar to FIG. 4, showing another configuration of the low-profile head rail in the stowed, sofa position.

Referring now to FIG. 5, the disposition of the folding mechanism 204 within the sofa frame 202 is again illustrated when the folding mechanism 204 is in the stowed, sofa position. In one embodiment of the present invention, the uppermost portion of the head section 306 at the uppermost edge of the head end rail 316 is disposed at a spacing not substantially above the generally horizontal plane 402 defined by the uppermost edge of the foot section 312 including the foot section support legs 328. Another embodiment of the present invention involves a generally horizontal plane 502 defined by the lowermost edge of the breast rail 208. In this embodiment, the uppermost edge of the head end rail 316 is disposed at a spacing above the generally horizontal plane 402 but below the generally horizontal plane 502. Thus, in the presently discussed embodiment, no component of the folding mechanism 204 extends into the back cavity 214 of the sofa frame 202. In yet another embodiment of the present invention, the back cavity 214 of sofa frame 202 is configured to contain various internal bracing that does not interfere with any component of the folding mechanism 204. The discussed embodiments of the present invention are accomplished because, as discussed above and as best illustrated in FIG. 3, head side rails 314 have been shortened. Additionally, as discussed above, when the folding mechanism 204 is in the extended, sleeper position, the length from back to front that is lost by shortening head section 306 is added to the side rails 318, 322 of the main middle and foot sections 308, 312.

Figure 8:
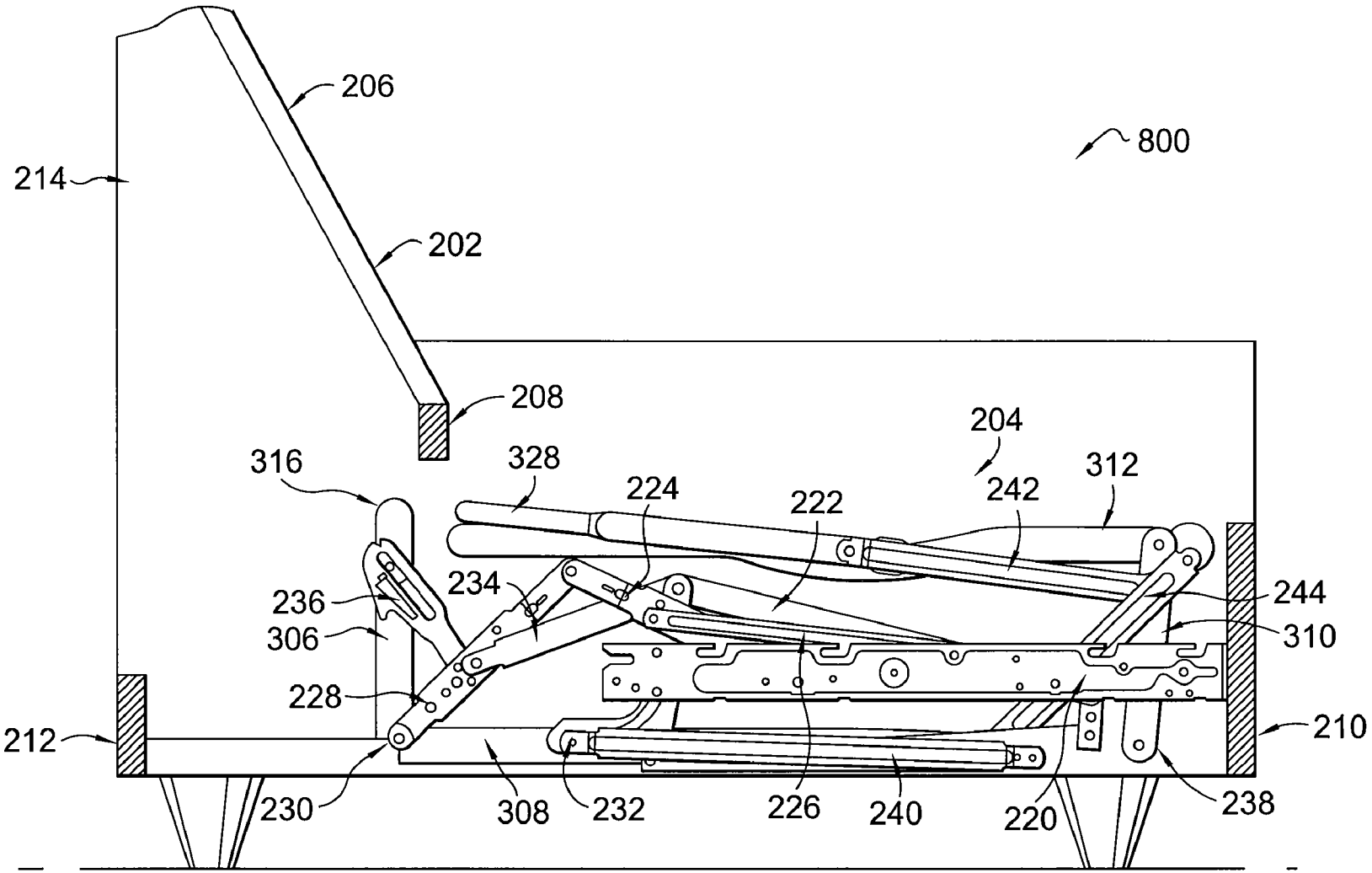
FIG. 8 is a profile view of a deep-seated sofa sleeper, in the stowed, sofa position, according to the present invention.
Figure 9:
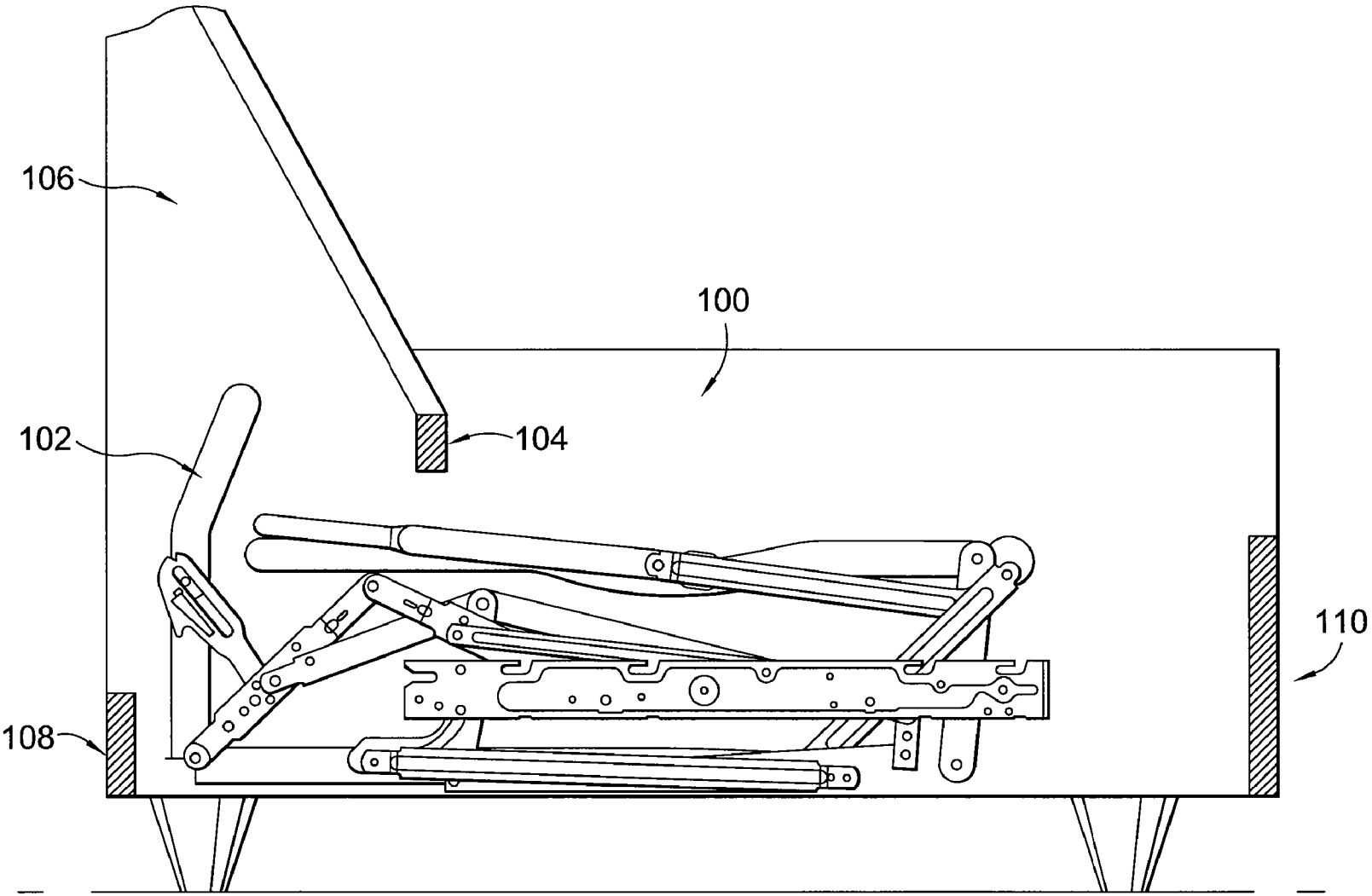
FIG. 9 is a profile view of the prior art sofa sleeper disposed in a deep-seated sofa frame in a stowed, sofa position.

Referring now to FIG. 8, a sofa sleeper with a deep-seated configuration according to the present invention is designated generally with the reference numeral 800. The disposition of the folding mechanism 204 within the sofa frame 202 is illustrated when the folding mechanism 204 is in the stowed, sofa position. In one embodiment of the present invention, the deep-seated configuration includes lengthening the sofa frame 202, resulting in a longer distance between back rail 212 and front rail 210. As will be understood by one of ordinary skill in the art, in one embodiment of the present invention, the folding mechanism 204 is disposed in a forward-biased orientation generally abutting front rail 210. In the forward-biased orientation of the present embodiment, the folding mechanism 204 can be extended from the stowed, sofa position to the extended, sleeper position without conflicting with front rail 210. Moreover, in this embodiment, head section 306 does not conflict with breast rail 208 in a forward-biased orientation because, as discussed above and as illustrated in FIG. 3, head side rails 314 have been shortened.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to invention. It will be understood that certain features and sub-combinations are of utility and may be employed without reference to other features and sub-combinations. This is contemplated and within the scope of the claims.

The invention claimed is:

1. A sofa sleeper mechanism, comprising:

a head section having a head end and an opposing end, said head end having an uppermost edge;

a main middle section pivotally coupled with said opposing end of said head section;

a secondary middle section pivotally coupled with said main middle section; and a foot section having a foot end and an opposing end, said opposing end of said foot section pivotally coupled with said secondary middle section, wherein the sofa sleeper mechanism is movable from a stowed position with said foot section, main middle section, and secondary middle section folded in a generally U-shaped orientation that is configured to be contained within a sofa sleeper, to an extended position with said head, main middle, secondary middle, and foot sections orientated generally in a linear plane, wherein, in said stowed position, said folded foot section has an upper surface defining a plane, and wherein, in said stowed position, said uppermost edge of said head end does not extend substantially above said plane defined by said upper surface of said folded foot section.

2. The sofa sleeper mechanism of claim 1 wherein said head section comprises an end rail oriented at said head end of said head section interconnected with a pair of side rails.

3. The sofa sleeper mechanism of claim 2 wherein said side rails are substantially linear.

4. The sofa sleeper mechanism of claim 1 further comprising an elongated said main middle section and an elongated said foot section such that the sofa sleeper mechanism supports a standard sofa sleeper mattress.

5. A sofa sleeper mechanism, comprising:

a head section having a head end and an opposing end, said head end having an uppermost edge;

a main middle section pivotally coupled with said opposing end of said head section;

a secondary middle section pivotally coupled with said main middle section; and a foot section having a foot end and an opposing end, said opposing end of said foot section pivotally coupled with said secondary middle section, wherein the sofa sleeper mechanism is movable from a stowed position with said foot section, main middle section, and secondary middle section folded in a generally U-shaped orientation that is configured to be contained within a sofa sleeper, to an extended position with said head, main middle, secondary middle, and foot sections orientated generally in a linear plane, wherein, in said stowed position, said folded foot section has an upper surface defining a plane, and wherein, in said stowed position, said uppermost edge of said head end is generally aligned with said plane defined by said upper surface of said folded foot section.

6. The sofa sleeper mechanism of claim 5 wherein said head section comprises an end rail oriented at said head end of said head section interconnected with a pair of side rails.

7. The sofa sleeper mechanism of claim 6 wherein said side rails are substantially linear.

8. The sofa sleeper mechanism of claim 5 further comprising an elongated said main middle section and an elongated said foot section such that the sofa sleeper mechanism supports a standard sofa sleeper mattress.

9. A sofa sleeper, comprising:

a sofa frame having a back and a breast rail, said back having a back cavity and said breast rail having a lowermost edge; and a folding mechanism that folds into and out of said sofa frame, said folding mechanism extendable from a first position to a second position, said folding mechanism having a head section, said head section having a head end with an uppermost edge and an opposing end, a main middle section pivotally coupled with said opposing end of said head section, a secondary middle section pivotally coupled with said main middle section, and a foot section pivotally coupled with said secondary middle section, wherein, in said first position, said head, main middle, secondary middle, and foot sections of said folding mechanism are extended and oriented in a generally linear plane, wherein, in said second position, said head, main middle, secondary middle, and foot sections of said folding mechanism are folded and stowed within said sofa frame, and wherein, in said second position, said uppermost edge of said head end is disposed at a spacing vertically beneath said lowermost edge of said breast rail.

10. The sofa sleeper of claim 9 wherein said head section of said folding mechanism comprises an end rail oriented at said head end of said head section interconnected with a pair of side rails.

11. The sofa sleeper of claim 10 wherein said side rails are substantially linear.

12. The sofa sleeper of claim 9 wherein, in said second position, said head section does not extend into said back cavity.

13. The sofa sleeper of claim 12 wherein said back cavity contains internal bracing.

14. The sofa sleeper of claim 9 wherein said folding mechanism further comprises an elongated said middle section and an elongated said foot section such that said folding mechanism supports a standard sofa sleeper mattress in said first position.

15. The sofa sleeper of claim 9 wherein said sofa frame has a front end and a back end, said sofa frame further comprising a front rail oriented at said front end.

16. The sofa sleeper of claim 15 wherein, in said second position, said folding mechanism has a forward-biased orientation within said sofa frame and generally abuts said front rail.

17. The sofa sleeper of claim 9 further comprising a mattress wherein said mattress is secured to said head section of said folding mechanism.

* * * * *